US008622761B2

(12) United States Patent
Le Page

(10) Patent No.: US 8,622,761 B2
(45) Date of Patent: Jan. 7, 2014

(54) ELECTRICAL INSTALLATION SYSTEM AND METHOD USING VARIABLY-LOCATABLE ELECTRICAL SOCKETS

(76) Inventor: Hayden Le Page, Cheltenham (AU)

( * ) Notice: Subject to any disclaimer, the term of this patent is extended or adjusted under 35 U.S.C. 154(b) by 15 days.

(21) Appl. No.: 13/387,501

(22) PCT Filed: Jul. 27, 2010

(86) PCT No.: PCT/AU2010/000937

§ 371 (c)(1),
(2), (4) Date: Jan. 27, 2012

(87) PCT Pub. No.: WO2011/011813

PCT Pub. Date: Feb. 3, 2011

(65) Prior Publication Data

US 2012/0129372 A1 May 24, 2012

(30) Foreign Application Priority Data

Jul. 27, 2009 (AU) ..... 2009903504

(51) Int. Cl.
*H01R 4/60* (2006.01)

(52) U.S. Cl.
USPC ..... 439/211

(58) Field of Classification Search
USPC ..... 439/209–222
See application file for complete search history.

(56) References Cited

U.S. PATENT DOCUMENTS

| | | | | |
|---|---|---|---|---|
| 6,220,880 | B1 * | 4/2001 | Lee et al. | 439/214 |
| 7,052,299 | B2 * | 5/2006 | Kim et al. | 439/211 |
| 7,207,523 | B2 * | 4/2007 | Callahan et al. | 244/118.6 |
| 7,214,079 | B2 * | 5/2007 | Kim et al. | 439/211 |
| 7,347,734 | B1 * | 3/2008 | Teitelbaum | 439/652 |
| 7,547,221 | B2 * | 6/2009 | Kim et al. | 439/211 |
| 2003/0224636 | A1 * | 12/2003 | Lorenzen et al. | 439/110 |
| 2005/0202689 | A1 * | 9/2005 | Kim et al. | 439/43 |
| 2006/0049311 | A1 * | 3/2006 | Callahan et al. | 244/118.6 |
| 2007/0184703 | A1 * | 8/2007 | Kim et al. | 439/346 |
| 2008/0214030 | A1 * | 9/2008 | Ohanesian | 439/110 |

FOREIGN PATENT DOCUMENTS

| | | |
|---|---|---|
| GB | 2424317 B | 4/2008 |
| JP | 2007-166418 | 6/2007 |

* cited by examiner

*Primary Examiner* — Chandrika Prasad
(74) *Attorney, Agent, or Firm* — K&L Gates LLP

(57) ABSTRACT

A power-socket variable location system and method provide one or more variably-locatable electrical sockets and data connection points along a wall to enable pins of an electrical plug to be inserted at selectively variable locations along the wall to obtain electrical power. An elongate-electrical-conductor is located along the wall. A conductor-enclosure encases the electrical-conductor to prevents inadvertent contact between a user and the electrically-live conductor inside. One or more power-sockets each have pin-to-conductor-conduction-means that are able to electrically link the elongate-electrical-conductor to pins of an electrical plug inserted into the power-socket. The power-sockets can be selectively attached at any location along the conductor-enclosure such that when the pins of an electrical plug are inserted into the power-sockets, an electrical connection is made between the pins and the power source through the pin-to-conductor-conduction-means and via the elongate-electrical-conductor. One or more data connection points are able to be selectively attached at substantially any location along the conductor-enclosure.

23 Claims, 12 Drawing Sheets

ELECTRICAL INSTALLATION SYSTEM AND METHOD USING VARIABLY-LOCATABLE ELECTRICAL SOCKETS

The present application claims the priority under 35 U.S.C. 371 of Australian Patent Application Serial No. 2009903504 filed Jul. 27, 2009 and of PCT Application Serial No. PCT/AU2010/000937 filed Jul. 27, 2010, which applications are incorporated in their entirety herein by reference.

FIELD OF INVENTION

The present invention relates to a system that provides one or more variably-locatable electrical sockets and data connection points along a wall, and a related method.

BACKGROUND OF THE INVENTION

In business offices and commercial premises, there is often a need to provide a large number of power sockets at many locations along the base or skirting boards of the walls of a room or office. Many power sockets are needed to run the large number of electrical apparatus used in a typical office, such as computers, facsimile machines, photocopiers, lighting etc.

Moreover, with the ubiquity of networked computers in offices, there is also a need to provide a large number of data connection points. These data connection points allow individual computers or terminals to be connected to a network of computers.

The arrangement of office layouts, and the positioning of desks, computers and other office equipment within the office often change from time to time. Such change can require the number and location of the large number of power sockets and/or data connection points to be shifted to more convenient locations according to the new office layout.

To cater for this need to shift the position of power sockets and/or data connection points, there is a known system 10 of providing such a large number of variably-locatable electrical power sockets, and also with or without data connection points, which is shown schematically in FIG. 1. In the known system 10, a large number of power sockets 40 and data connection points 41 are located at the base of the walls 101 of rooms in such a manner that the location of these can be changed from time to time.

The known system makes use of metal compartments 20 which are positioned along the length of the base of each wall at the level of the skirting board.

At generally any location along these compartments 20, it is possible to selectively attach one or more power sockets 40 and/or data connection points 41, as shown in FIG. 1.

In this known system, such a large number of power sockets alone, or with data connection points, requires a correspondingly large number of wires and cables. These wire and cables are concealed within the elongate compartments 20 which are referred to as cable ducts 20. The prior art cable ducts 20 act as enclosures for concealing the cables or wires associated with the power sockets or data connection points.

The large quantity of cables need to be concealed in the ducts 20 because it is often unfeasible to contain the cables inside the walls 101, particularly for solid walls such as brick walls. Also, in those instances where cables are installed inside hollow walls, the subsequent task of relocating the power sockets 40 and data points 41, from time to time, is even more difficult because of the need for cutting open and subsequent repair of the walls, including re-plastering and re-painting etc.

A problem with the known system of FIG. 1 arises from the complexity of the process of installation or alteration of the location of the ducts, power sockets alone, or with data points. This complexity can lead to higher costs.

Moreover, the long duration of the alteration work can often lead to disruption to the staff that usually work in those parts of an office where the alteration work is carried out on the system 10. This disruption has its associated effect on the costs or loss of productivity of those office workers affected by the disruption.

There is complexity in the process of initial installation of the known system 10. The complexity arises because these metal cable ducts 20 are manufactured and supplied in standard fixed lengths, and must therefore be cut to required size by the workman. For instance, in FIG. 1, if gaps between power sockets and/or data points (dimensions A or B) are not of the standard fixed length, then the workman has to cut the portion of the duct to required size. The cutting procedure tends to be time-consuming because the metal sheet material of the ducts 20 has to be cut to precise dimensions with little margin for error, for example, within an exacting margin of plus or minus half a millimeter. This is to avoid unsightly gaps at the butt joint of adjoining ducts.

Moreover, when changing the location of power sockets alone, or with data points, the existing ducts 20 have to be replaced with fresh ducts that may have to be cut to the new dimensions, thus involving the same complex and painstaking process of preparing ducts according to the new dimensions.

Another time-consuming aspect of the system can be the need to connect each metal duct 20 to an earth, and also to ensure an electrical connection between adjoining ducts 20 to facilitate the earthing of these adjoining ducts.

Moreover, when changing the location of power sockets or data points, the existing ducts 20 have to be removed. This causes the cables, that were concealed in the ducts, to suddenly be exposed. Since such ducts can sometimes contain a multitudinous amount of cables that are tightly crammed into the duct, the removal of the duct can result in these cables spilling out when re-exposed, which presents an inconvenient task to re-pack the cables tightly in the fresh duct that has the new dimensions. As an example, there can sometimes be, for example, fifty or eighty data cables crammed into the duct, plus power cables. This degree of compactness of power and data cables inside the duct can lead to difficulties when individual cables need to be altered or re-wired.

For example, in an office environment, there might be a need to provide ten power sockets, and also ten data connection points. The power sockets can be daisy-chained all from one power cable, however, each of the ten data connection points has to be supplied as an individual data cable. Hence, when power sockets and data points are provided together, the volume taken up by the numerous data cables can often present a problem. For instance, there could be four power cables used to daisy-chain eighty power sockets, with an accompanying eighty data cables needed to create the data connection points.

Another problem is that, when power sockets are being installed, the power for that part of the room has to be turned off. Thus, if the installation work is carried out during office hours, the temporary shutdown of power inconveniences those office workers would rely on electrical power for their office equipment.

Moreover, in the known system of FIG. 1, often during installation, the workman has to cut and splice power cables in those instances when the existing length of cable does not suit the updated configuration. Once again, this cutting and splicing of power cables adds to the time required for installation, and thus can inconvenience the people would normally use that area of the office. Thus, if that particular power socket has to be removed or shifted in location, it sometimes requires the workman to electrically re-wire the entire connection, which involves work on the wiring of the new power socket location, as well as re-wiring work at the former power socket location. Also, a detrimental side effect of this complex electrical wiring work is that the power supply to that area of the building needs to be turned off for the duration of the work. This disruption, once again, has an effect on costs or loss of productivity of those office workers who cannot use their computers or electrical equipment for that period of time.

An object of the present invention is to overcome or at least ameliorate one or more of the problems in the prior art, or to provide an improved alternative.

SUMMARY OF INVENTION

According to the present invention, there is provided a method of providing one or more variably-locatable electrical sockets along a wall to enable pins of an electrical plug to be inserted at selectively variable locations along the wall to obtain electrical power therefrom, the method comprising:

providing elongate-electrical-conductor-means along at least part of a wall;

providing elongate-conductor-enclosure-means along the wall so as to substantially enclose the elongate-electrical-conductor-means therein in its interior;

connecting the elongate-electrical-conductor-means to a power source, such that, in use, the elongate-conductor-enclosure-means prevents inadvertent contact between a user and the electrically-live elongate-electrical-conductor-means therein;

providing a power-socket-means that has pin-to-conductor-conduction-means able to electrically link the elongate-electrical-conductor-means to pins of an electrical plug inserted into the power-socket-means; and selectively attaching said power-socket-means at substantially any location along the elongate-conductor-enclosure-means such that, when the pins of an electrical plug are inserted into the power-socket-means, an electrical connection is made between the pins and said power source through the pin-to-conductor-conduction-means and via the elongate-electrical-conductor-means, wherein during attachment of the power-socket means to the elongate-conductor-enclosure means, the method includes:

using straight-ahead-alignment-means to cause a leading portion of the pin-to-conductor-conduction-means, at instant of actual entrance, to enter at least substantially straight into the elongate-electrical-conductor-means rather than entering misaligned or entering at an angle that causes damage of the pin-to-conductor-conduction-means, and wherein the straight-ahead-alignment-means includes:

a pivot-support which has a first-support-portion and a second-support-portion such that, during the attachment, the method includes:

pivotally supporting the power-socket-means using the first-support-portion such that the pin-to-conductor-conduction-means moves towards the elongate-conductor-enclosure-means in a false trajectory, and prior to the instant of actual entrance of the pin-to-conductor-conduction-means into the elongate-electrical-conductor-means, supporting the power-socket-means using the second-support-portion such that the pin-to-conductor-conduction-means enters the elongate-electrical-conductor-means at least substantially straight ahead in a true trajectory to avoid damage to the pin-to-conductor-conduction-means.

Preferably, the method also includes selectively attaching one or more data connection points at substantially any location along the elongate-conductor-enclosure-means;

and wherein the method includes using data-cable-confinement-means within the elongate-conductor-enclosure-means to confine any data cables, associated with the one or more data connection points, to part of the interior of the elongate-conductor-enclosure-means so as to avoid interference between the data cables and the pin-to-conductor-conduction-means and the elongate-electrical-conductor-means within the elongate-conductor-enclosure-means.

Preferably, immediately prior to the instant of actual entrance of the pin-to-conductor-conduction-means into the elongate-electrical-conductor-means, the method includes transitioning the support of the power-socket-means from the first-support-portion to the second-support-portion.

Preferably, the elongate-conductor-enclosure-means is provided with facia-panel-means that is removable to reveal and provide access to the interior of the elongate-conductor-enclosure-means, and wherein the method includes adjusting the length of the facia-panel-means by breaking the facia-panel-means along scored lines of weakness provided thereon.

According to another aspect of the present invention, there is provided a power-socket variable location system adapted to provide one or more variably-locatable electrical sockets along a wall to enable pins of an electrical plug to be inserted at selectively variable locations along the wall to obtain electrical power therefrom, the system comprising:

elongate-electrical-conductor-means adapted to be located, in use, along at least part of a wall and adapted to be connected to a power source;

elongate-conductor-enclosure-means adapted to substantially enclose the elongate-electrical-conductor-means therein in its interior such that, in use, the elongate-conductor-enclosure-means prevents inadvertent contact between a user and the electrically-live elongate-electrical-conductor-means therein;

one or more power-socket-means that each have pin-to-conductor-conduction-means able to electrically link the elongate-electrical-conductor-means to pins of an electrical plug inserted into the power-socket-means;

straight-ahead-alignment-means adapted, during attachment of the power-socket-means to the elongate-conductor-enclosure-means, to enable a leading portion of the pin-to-conductor-conduction-means, at instant of actual entrance, to enter at least substantially straight into the elongate-electrical-conductor-means rather than entering misaligned or entering at an angle that causes damage of the pin-to-conductor-conduction-means; wherein the straight-ahead-alignment-means includes a pivot-support which has a first-support-portion and a second-support-portion such that, during the attachment:

the first-support-portion, in use, is able to pivotally support the power-socket-means such that the pin-to-conductor-conduction-means moves towards the elongate-conductor-enclosure-means in a false trajectory, and the second-support-portion, in use, is able to support the power-socket-means such that, immediately prior to the instant of actual entrance of the pin-to-conductor-conduction-means into the elongate-electrical-conductor-means, the pin-to-conductor-conduction-means enters the elongate-electrical-conductor-means at least substantially straight ahead in a true trajectory to avoid damage to the pin-to-conductor-conduction-means.

wherein said one or more power-socket-means are able to be selectively attached at substantially any location along the elongate-conductor-enclosure-means such that when the pins of an electrical plug are inserted into the power-socket-means, an electrical connection is able to made between the pins and said power source through the pin-to-conductor-conduction-means and via the elongate-electrical-conductor-means.

Preferably, in the system, one or more data connection points are able to be selectively attached at substantially any location along the elongate-conductor-enclosure-means;

and wherein the elongate-conductor-enclosure-means includes therein data-cable-confinement-means adapted to confine any data cables, associated with the one or more data connection points, to part of the interior of the elongate-conductor-enclosure-means sufficient to avoid interference between the data cables and the pin-to-conductor-conduction-means and the elongate-electrical-conductor-means within the elongate-conductor-enclosure-means.

Preferably, in use of the system, support of the power-socket-means transitions from the first-support-portion to the second-support-portion immediately prior to the instant of actual entrance of the pin-to-conductor-conduction-means into the elongate-electrical-conductor-means.

Preferably, the elongate-conductor-enclosure-means is made of a non-conductive material.

Preferably, the elongate-conductor-enclosure-means is provided with facia-panel-means that is removable to reveal and provide access to the interior of the elongate-conductor-enclosure-means, and wherein the facia-panel-means is adapted to be adjustable in terms of its length by breaking the facia-panel-means along scored lines of weakness provided thereon.

According to another aspect of the present invention, there is provided a method of providing one or more variably-locatable electrical sockets along a wall to enable pins of an electrical plug to be inserted at selectively variable locations along the wall to obtain electrical power therefrom, the method comprising:

providing elongate-electrical-conductor-means along at least part of a wall;

providing elongate-conductor-enclosure-means along the wall so as to substantially enclose the elongate-electrical-conductor-means therein in its interior;

connecting the elongate-electrical-conductor-means to a power source, such that, in use, the elongate-conductor-enclosure-means prevents inadvertent contact between a user and the electrically-live elongate-electrical-conductor-means therein;

providing a power-socket-means that has pin-to-conductor-conduction-means able to electrically link the elongate-electrical-conductor-means to pins of an electrical plug inserted into the power-socket-means, the pin-to-conductor conduction-means including a switch to allow the enabling and disabling of the electrical link between the elongate-electrical-conductor-means and at least one of the pins of the electrical plug; and selectively attaching said power-socket-means at substantially any location along the elongate-conductor-enclosure-means such that, when the pins of an electrical plug are inserted into the power-socket-means, an electrical connection is made between the pins and said power source through the pin-to-conductor-conduction-means and via the elongate-electrical-conductor-means.

According to another aspect of the present invention, there is provided a power-socket variable location system adapted to provide one or more variably-locatable electrical sockets along a wall to enable pins of an electrical plug to be inserted at selectively variable locations along the wall to obtain electrical power therefrom, the system comprising:

elongate-electrical-conductor-means adapted to be located, in use, along at least part of a wall and adapted to be connected to a power source;

elongate-conductor-enclosure-means adapted to substantially enclose the elongate-electrical-conductor-means therein in its interior such that, in use, the elongate-conductor-enclosure-means prevents inadvertent contact between a user and the electrically-live elongate-electrical-conductor-means therein;

one or more power-socket-means that each have pin-to-conductor-conduction-means able to electrically link the elongate-electrical-conductor-means to pins of an electrical plug inserted into the power-socket-means, the pin-to-conductor-conduction-means including a switch to allow the enabling and disabling of the electrical link between the elongate-electrical-conductor-means and at least one of the pins of the electrical plug;

wherein said one or more power-socket-means are able to be selectively attached at substantially any location along the elongate-conductor-enclosure-means such that when the pins of an electrical plug are inserted into the power-socket-means, an electrical connection is able to made between the pins and said power source through the pin-to-conductor-conduction-means and via the elongate-electrical-conductor-means.

According to another aspect of the present invention, there is provided a power-socket variable location system adapted power-socket variable location system adapted to provide one or more variably-locatable electrical sockets along a wall to enable pins of an electrical plug to be inserted at selectively variable locations along the wall to obtain electrical power therefrom, the system comprising:

elongate-electrical-conductor-means adapted to be located, in use, along at least part of a wall and adapted to be connected to a power source;

elongate-conductor-enclosure-means adapted to substantially enclose the elongate-electrical-conductor-means therein in its interior such that, in use, the elongate-conductor-enclosure-means prevents inadvertent contact between a user and the electrically-live elongate-electrical-conductor-means therein;

one or more power-socket-means that each have pin-to-conductor-conduction-means able to electrically link the elongate-electrical-conductor-means to pins of an electrical plug inserted into the power-socket-means, the pin-to-conductor-conduction-means including a switch to allow the enabling and disabling of the electrical link between the elongate-electrical-conductor-means and at least one of the pins of the electrical plug;

wherein said one or more power-socket-means are able to be selectively attached at substantially any location along the elongate-conductor-enclosure-means such that when the pins of an electrical plug are inserted into the power-socket-means, an electrical connection is able to made between the pins and said power source through the pin-to-conductor-conduction-means and via the elongate-electrical-conductor-means.

According to another aspect of the present invention, there is provided a method of providing one or more variably-locatable electrical sockets and data connection points along a wall to enable pins of an electrical plug to be inserted at selectively variable locations along the wall to obtain electrical power therefrom, the method substantially as hereinbefore described and illustrated with reference to the accompanying drawings.

According to another aspect of the present invention, there is provided a power-socket variable location system adapted to provide one or more variably-locatable electrical sockets and data connection points along a wall to enable pins of an electrical plug to be inserted at selectively variable locations along the wall to obtain electrical power therefrom, the system substantially as hereinbefore described and illustrated with reference to the accompanying drawings.

DRAWINGS

In order that the present invention might be more fully understood, embodiments of the invention will be described, by way of example only, with reference to the accompanying drawings, in which.

The drawings of the embodiment are not drawn precisely to scale, and are provided merely for illustration of principles of the embodiment.

DESCRIPTION OF EMBODIMENTS

Figure 2:
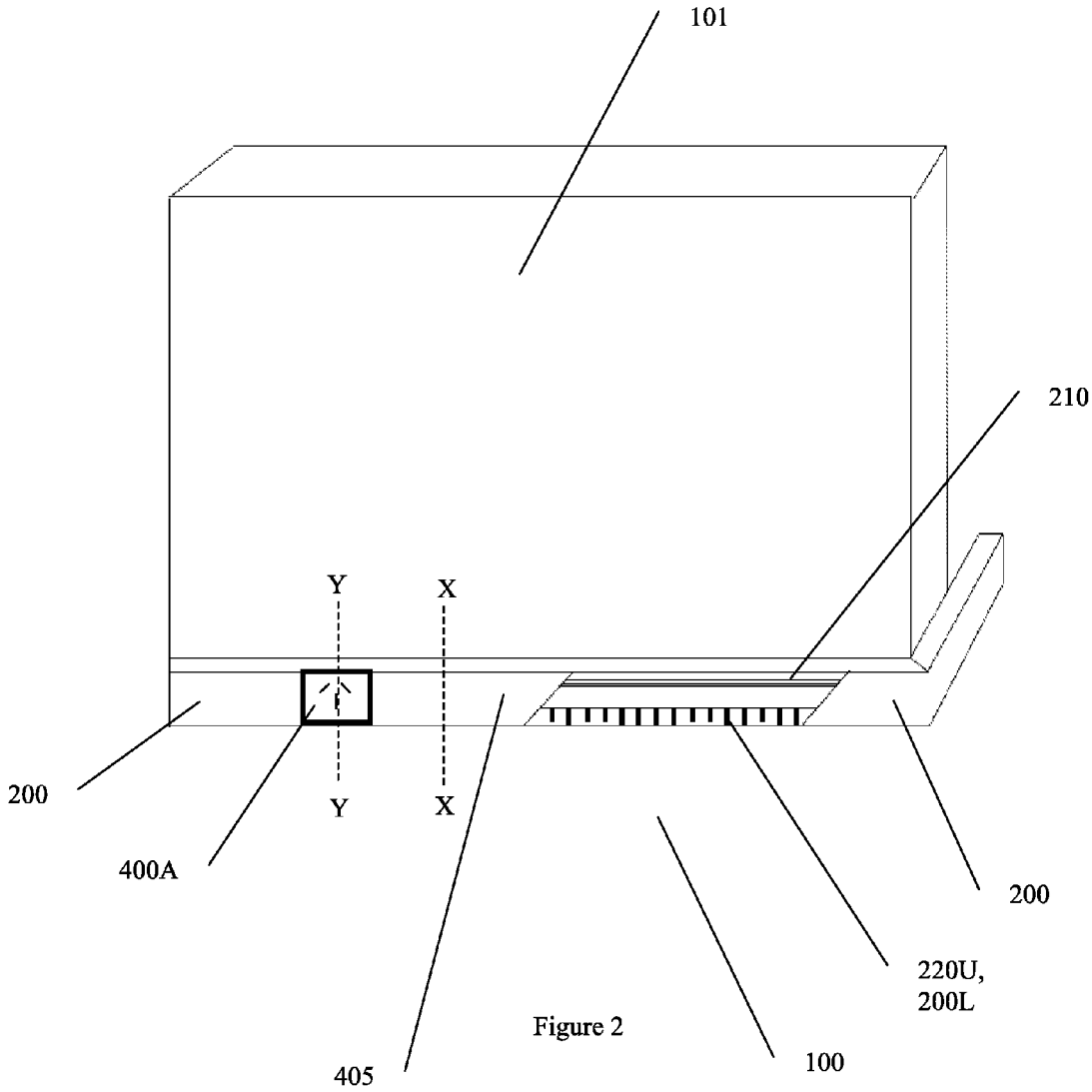
FIG. 2 shows a perspective view of an implementation of an embodiment of a power-socket variable location system. Part of the diagram in FIG. 2 is shown as a cut-away to reveal internal components of the system.

Referring to the accompanying drawings, FIG. 2 show a perspective, schematic view of an implementation of an embodiment of a power-socket variable location system 100.

The system 100 is adapted to provide one or more variably-locatable electrical sockets along a wall 101 (the wall is not drawn to scale).

FIG. 2 shows an elongate-conductor-enclosure-means in the form of an elongate conductor casing 200. In use, the conductor casing 200 is arranged along the wall 101, preferably along the base of the wall.

In other variations of the embodiment, the conductor casing 200 may be arranged along the wall at a height above the floor, for example, when the conductor casing 200 stretches horizontally along a wall just above the level of a table top or benchtop.

In other modifications, the conductor casing 200 may be arranged vertically along a wall, i.e. up and down the wall, depending on the needs of the particular environment.

FIG. 2 shows what appears to be a rather short conductor casing 200, however, in other practical embodiments, the conductor casing 200, of appropriate length, is able to be arranged along the base of the entire length of the wall 101 of a room, or part of the wall, as required.

Conductor Casing

Figure 4:
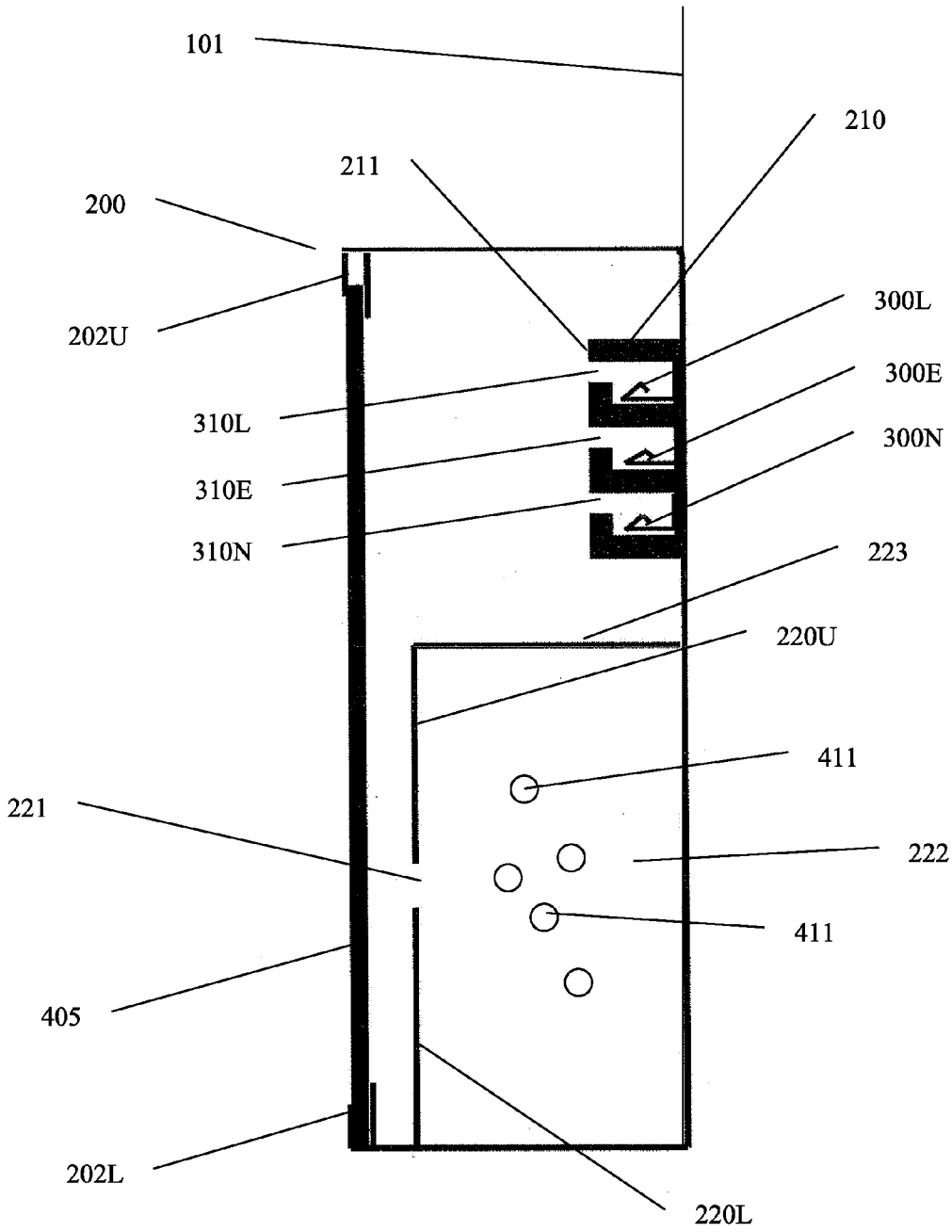
FIG. 4 shows a cross-section of the conductor casing of FIG. 3 as seen along the line X-X in FIG. 2.
Figure 5:
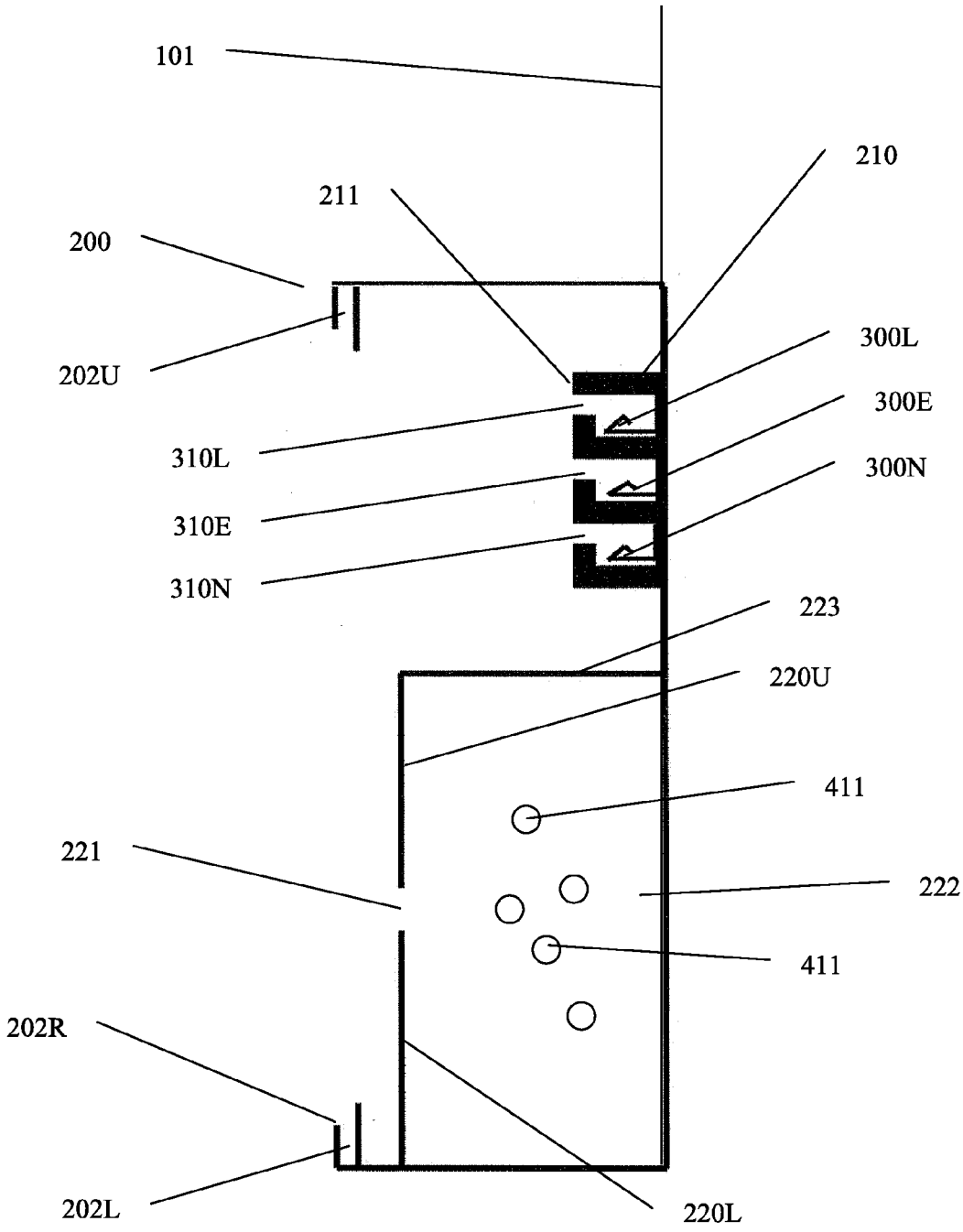
FIG. 5 shows the same conductor casing of FIG. 4 without a fascia panel.

FIGS. 4 and 5 show cross sections of the same conductor casing 200, as follows:

FIG. 4 shows a cross-section view of the casing 200 as seen along the line X-X in FIG. 2, at a location along the conductor casing 200 where there is no power socket. In such locations, the conductor casing 200 is provided with fascia-panel-means in the form of fascia panels 405. The fascia panels 405 are removable to reveal and provide access to the interior of the conductor casing 200.

The fascia panel 405 is positioned at the front of the casing 200, and held in place by upper 202U and lower slots 202L. The fascia panel 405 conceals the internal regions of the conductor casing 200. When the facsia panel 405 is removed, the interior or internal regions of the conductor casing 200 are revealed.

FIG. 5 shows the same conductor casing 200 without a fascia panel 405. The absence of fascia panel at this location is to enable power-socket-means, in the form of a variably-locatable power socket 400, to be inserted at that location (Y-Y).

Materials

Preferably, embodiments of the elongate-conductor-enclosure-means are made of non-conductive material. If the components of the elongate-conductor-enclosure-means were to be made from a conductive material, such as sheet metal, then it would increase the time required for installation because of the consequential, additional step of having to earth all those conductive components, to safeguard against the user touching electrically-live parts.

Hence, in the embodiment, for example, the conductor casing 200 and its main rail 210 are both made of non-conductive materials, such as an appropriate polymer material. This reduces installation time by avoiding the need for earthing of such components.

Power-Socket Variable Location

One or more of the variably-locatable power sockets 400A, 400B etc. can generally be selectively located at substantially any location along the conductor casing 200, even at the extreme ends of the casing 200.

This enables pins 51 of an electrical plug 50 to be inserted at those various locations along the wall in order to obtain electrical power from the sockets 400A, 400B etc.

For example, FIG. 2 shows a first power socket 400A that the workman has selected to be installed at a first location Y-Y along the conductor casing 200. A user is able to insert pins of an electrical power into the power socket 400A.

Figure 3:
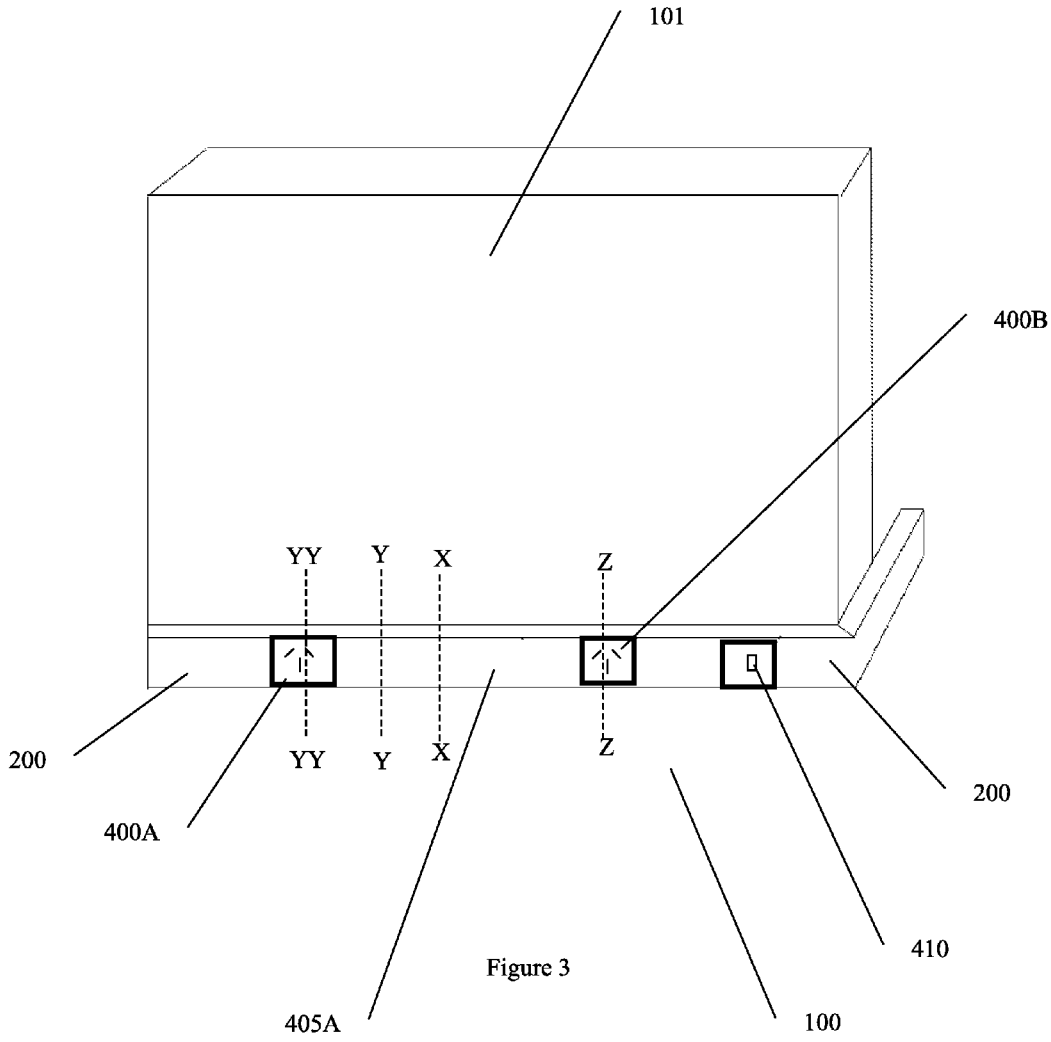
FIG. 3 shows the schematic, perspective view of FIG. 2 except with modifications to the system resulting from a shift of location of the power socket, and an addition of a data connection point.

FIG. 3 shows the same conductor casing 200 of FIG. 2, except that in FIG. 3 the user has moved the first power socket 400A away from position Y-Y- to a different location YY-YY that is closer to the left side of the conductor casing 200. In FIG. 3, the user has also attached a second power socket 400B to the same conductor casing 200 at a further location Z-Z. Consequently, the workman has also installed a new fascia panel 405A that has a longer dimension to span the wider gap between power sockets Z-Z, YY-YY.

In use, an elongate conductor casing 200 is arranged along a wall, and the user is able to add a large number of power sockets, subject to a limitation of the current and power supply.

In the embodiment, each time a power socket is inserted into the conductor casing 200, the socket is being added, in parallel, to the existing circuit in the casing. The number of sockets that can be inserted into a given length of casing 200 depends on the physical size of the sockets, which places a natural limit on the number of sockets that can be attached. Also, another limitation may be legislative regulations that may prescribe limits. Moreover, adding too many power sockets may cause the circuit breaker to trip. Hence, the usual guidelines should be heeded in relation to how many power sockets can be added in parallel to one circuit.

When the location and perhaps the number of power sockets have been changed, fresh fascia panel 405 is cut to size and slotted into the conductor casing 200 according to the new arrangement of the power sockets. It is substantially easier to cut a planar fascia panel 405, than it is to re-cut a replacement box-like metal compartments 20 of the prior art in FIG. 1.

Figure 8:
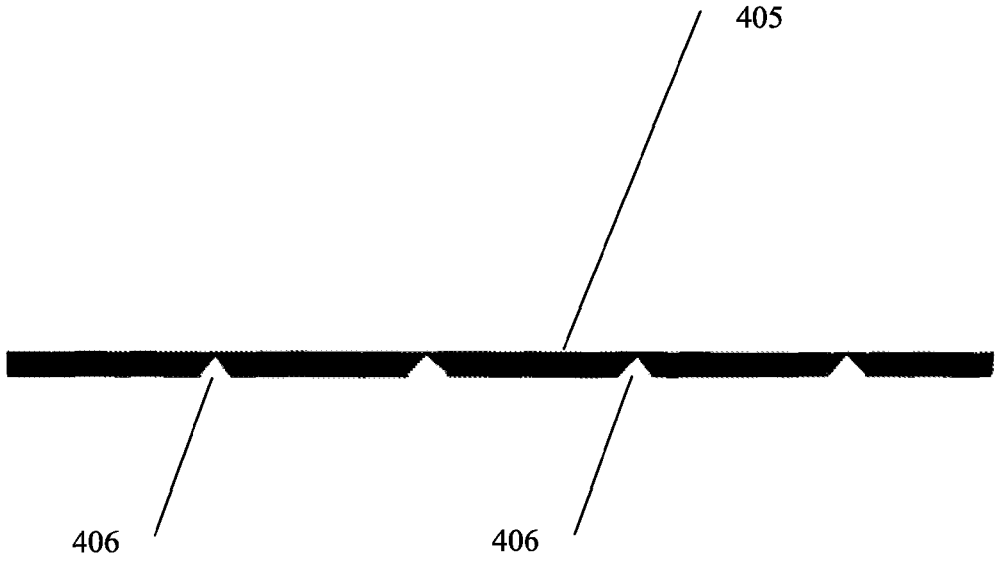
FIG. 8 shows a side view of an embodiment of a fascia panel.

In a modification, the facia-panel-means is adapted to be adjustable in terms of its length by breaking the facia-panel-means along scored lines of weakness provided thereon. For example, in FIG. 8, the fascia panel 405 may be provided in a form with scored lines 406 of weakness to allow the panel to be broken or snapped by hand at selective lengths. Thus, this modified fascia panel 405 can be broken by hand into appropriate lengths, rather than needing cutting tools such as saws. In this modification, the ability to reduce the size of the fascia panel 405 by breaking it along the scored lines 406 also avoids the creation of debris or saw dust that is usually produced when cutting the panel, for instance, with a mechanical saw.

Elongate Conductor Means

The conductor casing 200 acts as an enclosure for an elongate-electrical-conductor-means that is located within the casing 200.

In the embodiment, the elongate-electrical-conductor-means is in the form of a three-part set of elongate electrical contacts 300. The contacts 300 extend along the entire length of the casing 200. The contacts 300 have uniform cross-section along their entire length. In other embodiments, the contacts 300 can extend at least substantially along the entire length of the casing 200.

The three electrical contacts 300 consist of a live contact 300L, an earth contact 300E and a neutral 300N contact (the suffixes L, E and N denote Live, Earth and Neutral respectively).

In the embodiment, preferably the earth contact 300E is in the middle, while the active contact 300L is uppermost, and the neutral 300N is lowermost.

The conductor casing 200 includes a main rail 210 that encloses the electrical contacts 300. The main rail 210 of the conductor casing 200 substantially encloses the electrical contacts 300, except for providing narrow slits 310L, 310E, 310N in the face 211 of the main rail that provide limited access to the contacts 300 within.

Each slit 310 acts as a narrow opening that allows limited physical access to the electrical contacts 300E, 300N, 300L within the casing 200. This ensures that, in operation, the casing 200 minimises the likelihood of inadvertent contact between a user and the electrically-live contacts, 300E, 300N, 300L within the casing 200, since the slits are too narrow to allow insertion of a person's fingers.

In the embodiment, the main rail 210 is made of an insulating material, for example, Acrylonitrile Butadiene Styrene (ABS) polymer, or may be made from any suitable insulator that has sufficient stiffness required for the function of the main rail.

The electrical contacts 300 are made from a conductor material, for example, a copper and spring steel composite alloy.

In use, the conductor casing 200 is arranged along at least part of a wall, which effectively causes the elongate electrical contacts, 300E, 300N, 300L—which are inside the casing 200—to be arranged along that wall. The three contacts—active, earth and neutral 300L, 300E, 300N—are appropriately connected to a power source.

The elongate electrical contacts 300 act as an elongate, electrically-live power source that extends along the wall 101. One or more power sockets 400 can be inserted into and attached to the main rail 210 at any location along its length to draw electricity from the electrically-live contacts 300E, 300N, 300L.

Since the user is able to shift the location of power sockets 400 simply by removing and re-attaching the sockets 400 anywhere along the main rail 210, it has an advantage of avoiding the need for re-wiring the power socket each time the socket location is shifted.

Figure 1:
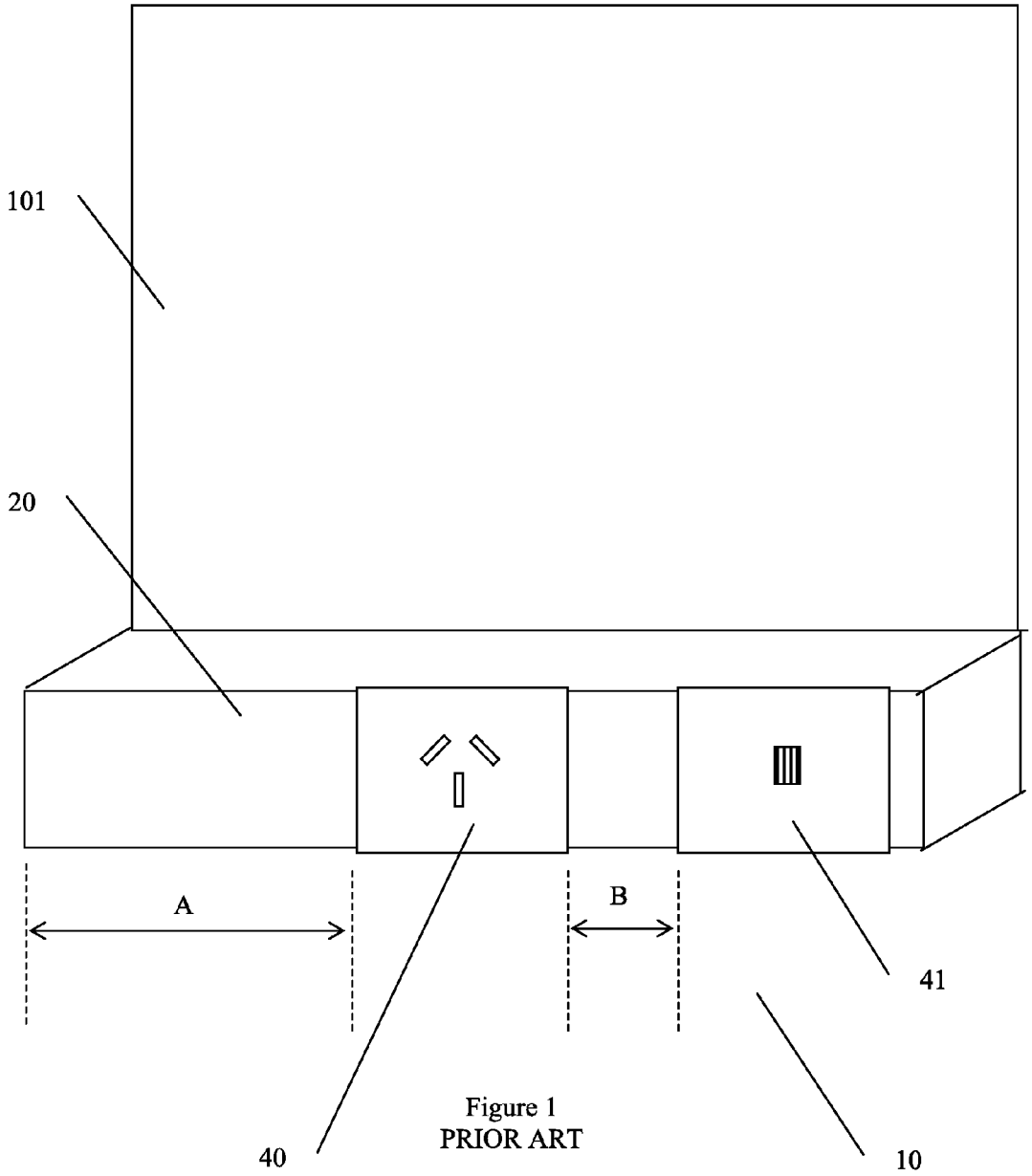
Figure 1 PRIOR ART
FIG. 1 shows a perspective, schematic view of part of a known system used to provide a large number of variably-locatable electrical power sockets alone, or with data connection points, along the base of a wall.

Furthermore, the amount of time needed to attach or shift a variably-locatable power socket 400 to another location on the main rail 210 is significantly less than the time needed in the known system of FIG. 1.

Another advantage of the present embodiment is a reduction in the amount of wires and cables relating to the power sockets 400A, 400B etc. The problem of the amount of wiring for the sockets, in the prior art, is at least ameliorated in the present embodiment by the power socket wiring being replaced by a single main rail 210, which is more compact, and which has a far neater appearance compared to a multitudinous mass of socket wiring.

A further advantage of the system of the present embodiment is that, when the location of power sockets 400 are shifted from time to time, there is no need to remove or open up the casing 200, and hence it avoids the problem of re-exposing the internal contents of the casing 200. This, in turn, avoids the problem of the contents of the casing 200 falling out when the casing is opened.

Pin-to-Conductor-Conduction-Means

Figure 6:
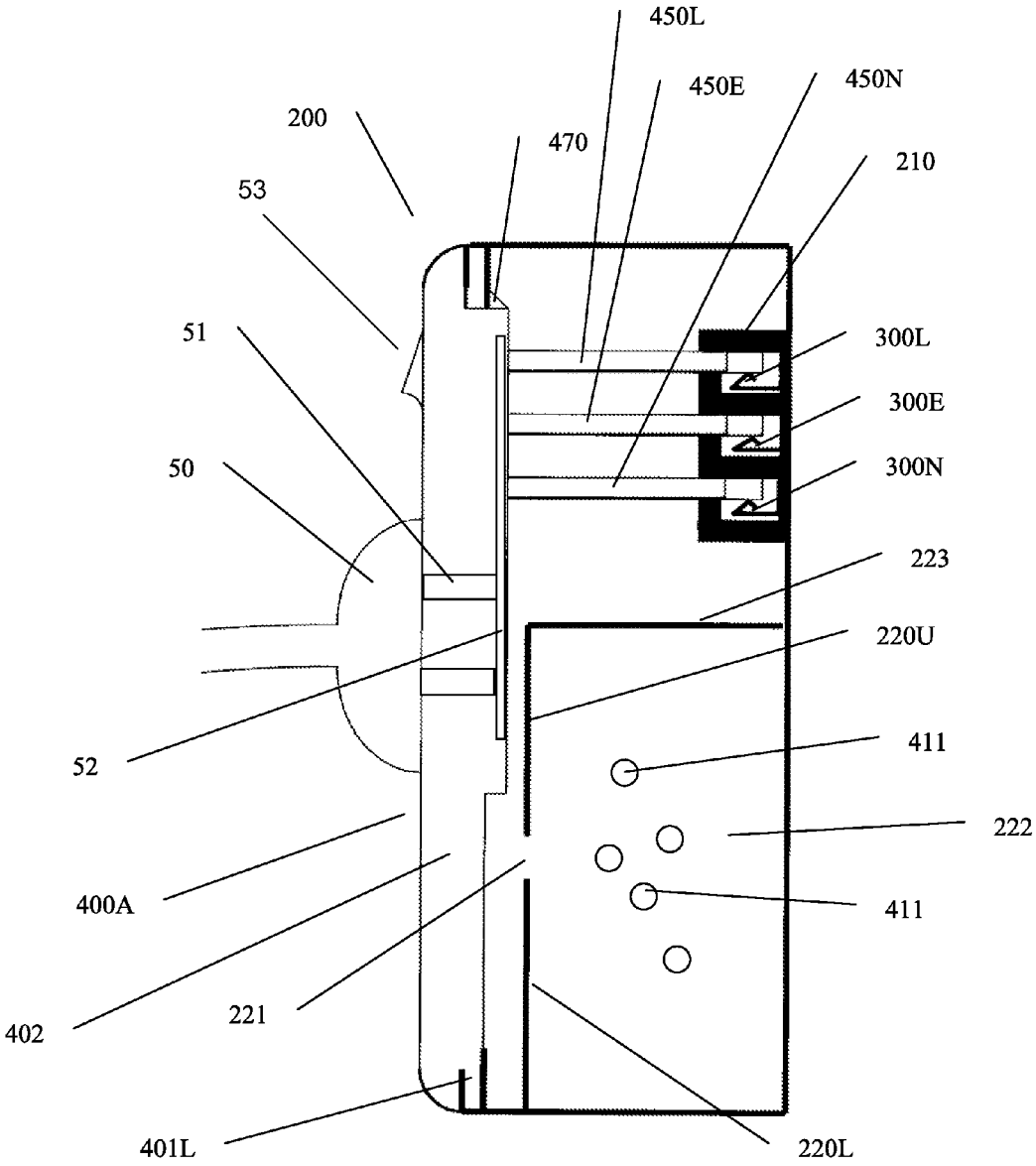
FIG. 6 shows a cross-section of the conductor casing of FIG. 3 as seen along the line Y-Y in FIG. 2.

FIG. 6 shows a cross-sectional view of a conductor casing 200, as seen along the line Y-Y in FIG. 2, shown with a variably-locatable power socket 400A attached to the casing 200.

In FIG. 6, an electrical plug 50 has been inserted into the variably-locatable power socket 400A (or 400B). The electrical plug 50 has pins 51.

In FIG. 6, there are metallic strips 52 behind the socket-body-frame 402. When the plug 50 is inserted into power socket 400A, the pins 51 of the plug connect with the metallic strip 52, thus creating a circuit through which electrical power can flow, from the electrically-live contacts 300E, 300N, 300L to the pins 51 and on to the electrical device that draws current from the plug 50.

Thus, in order to electrically connect the pins 51 to the electrically-live contacts 300E, 300N, 300L inside the main rail 210, each power socket 400, 400A, 400B has pin-to-conductor-conduction-means.

In FIG. 6, the pin-to-conductor-conduction-means is in a form that includes long connector pins 450 L, 450E, 450N. Each power socket 400, 400A and 400B preferably includes a power switch 53 which is interposed between the pins 51 and the electrically-live contact 300L, to allow switching on and off of the power supply to the plug 50 and thus to the appliance which is connected to the plug 50.

When the pins 51 of the electrical plug are inserted into the variably-locatable power socket 400, an electrical circuit is established, from the contacts 300E, 300N, 300L, through the long connector pins 450 L, 450E, 450N, to the pins 51 of the plug 50.

In the embodiment, most of the length of the long connector pins 450 L, 450E, 450N is protectively covered by an insulation material, except for the distal ends which are exposed as metallic conductive surfaces that can engage with the electrically-live contacts 300E, 300N, 300L In the embodiment, even though the narrowness of the slits 310 would prevent entry of a person's fingers, the slits may still not obstruct an unreasonable act of entry, for example, the insertion of a knife between the slits perhaps being a malicious act of vandalism. Therefore, in other modifications, the slits 310 can be modified by having struts or webbing that create a continuous series of segmented, short slits 310 through which the long connector pins 450 L, 450E, 450N can still enter, but which are too narrow to allow entry of small potential invasive objects, such as knives.

Installation Process

In FIG. 2, when the user wishes to attach a power socket 400A to the conductor casing 200 at a desired location, the process requires that a portion of the fascia panel 405, at the location, is removed and replaced with the power socket 400.

In the embodiment, during attachment of the power socket 400 to the conductor casing 200, it is advantageous for the long connector pins 450 L, 450E, 450N to enter the slits 310 of the main rail 210 at least in a substantially straight-ahead alignment.

Theoretically, the pins 450 should enter the slits in a perfectly straight-ahead alignment at the instant that they enter the slits 310, i.e. the pins should theoretically be 90 degrees with respect to the face plane 211 of the main rail. Furthermore, the reference to "straight-ahead" alignment also means that, as far as possible, the lateral surfaces of the long connector pins 450 L, 450E, 450N, at the moment of entry, should at least be substantially parallel to the internal surfaces of the slits 310. In other words, the longitudinal axis of each long connector pins 450 L, 450E, 450N should be at least substantially co-axial with an axis that runs through the longitudinal chamber of its corresponding slit 310.

In practice, however, in the embodiment, it should suffice for the pins 450 to merely enter the slits substantially straight-ahead to the extent that the leeway does not result in damage to the pins, which is actually the ultimate aim of ensuring appropriate pin-to-slit alignment. For example, in the embodiment, the pins can be within a range of approximately 85 to 90 degrees with respect to the face plane 211 of the main rail as they enter the slits 310.

In practice, in the exemplary embodiment, the connector pins 450 L, 450E, 450N would be perfectly 90 degrees with respect to the face plate 211 only once the pins are fully engaged with the slits 310.

The purpose of this straight-ahead alignment is to avoid damage to the long connector pins 450 L, 450E, 450N as they enter the slits 210.

In contrast, if such straight-ahead alignment is not achieved at least substantially, and if the long connector pins 450 L, 450E, 450N were to enter the slits at a significant angle, the pins 450 could be damaged as a result of being forced against the face 211 of main rail 210, rather than entering smoothly into slits, or may experience bending forces while entering the slits.

To avoid damage to the distal-ends of the connector pins 450 L, 450E, 450N at the instant of entry into the slits, in other modifications, the distal-ends can be slightly rounded. The intention is that, if the distal-ends of the pins approach the slits 310 on a trajectory that is slightly out of alignment, such that part of the pin hits the face plate 211 of the main rail, rather than entering straight into the slit 310, the curvature of the rounded distal end of the pins can cause the pin to be guided back into the its slit 310.

Therefore, to minimise or avoid such damage, the embodiment includes straight-ahead-alignment-means adapted, during attachment, to enable a leading, distal portion of the connector pins 450 L, 450E, 450N, at instant of actual entrance, to enter at least substantially straight into the slits 310, rather than entering misaligned or entering at an angle that may causes damage to the pins 450.

As an aside comment, by way of illustration only—as anyone who has tried to insert an electrical plug into a socket while in the dark—it is appreciated that it could potentially be difficult to manually guide the connector pins 450 L, 450E, 450N straight ahead into the slits, at the correct angle, without damaging the pins, particularly from constant disconnection and re-connection of the power socket 400. Moreover, this can be particularly difficult to achieve manually, merely through hand-eye-coordination, because, at the instant of entry, the user cannot see the pins 450 and slits 310 at the moment of entrance when the pins enter the slits.

Therefore, in the present embodiment, the straight-ahead-alignment-means provides a reference point for guiding the pins into the slits, rather than relying on the hand-eye coordination of the user.

The straight-ahead-alignment-means includes a pivot-support that acts as a reference point for the movement of the pins into the slits.

As will be described below, the embodiment includes a two-phase installation process.

Figure 7:
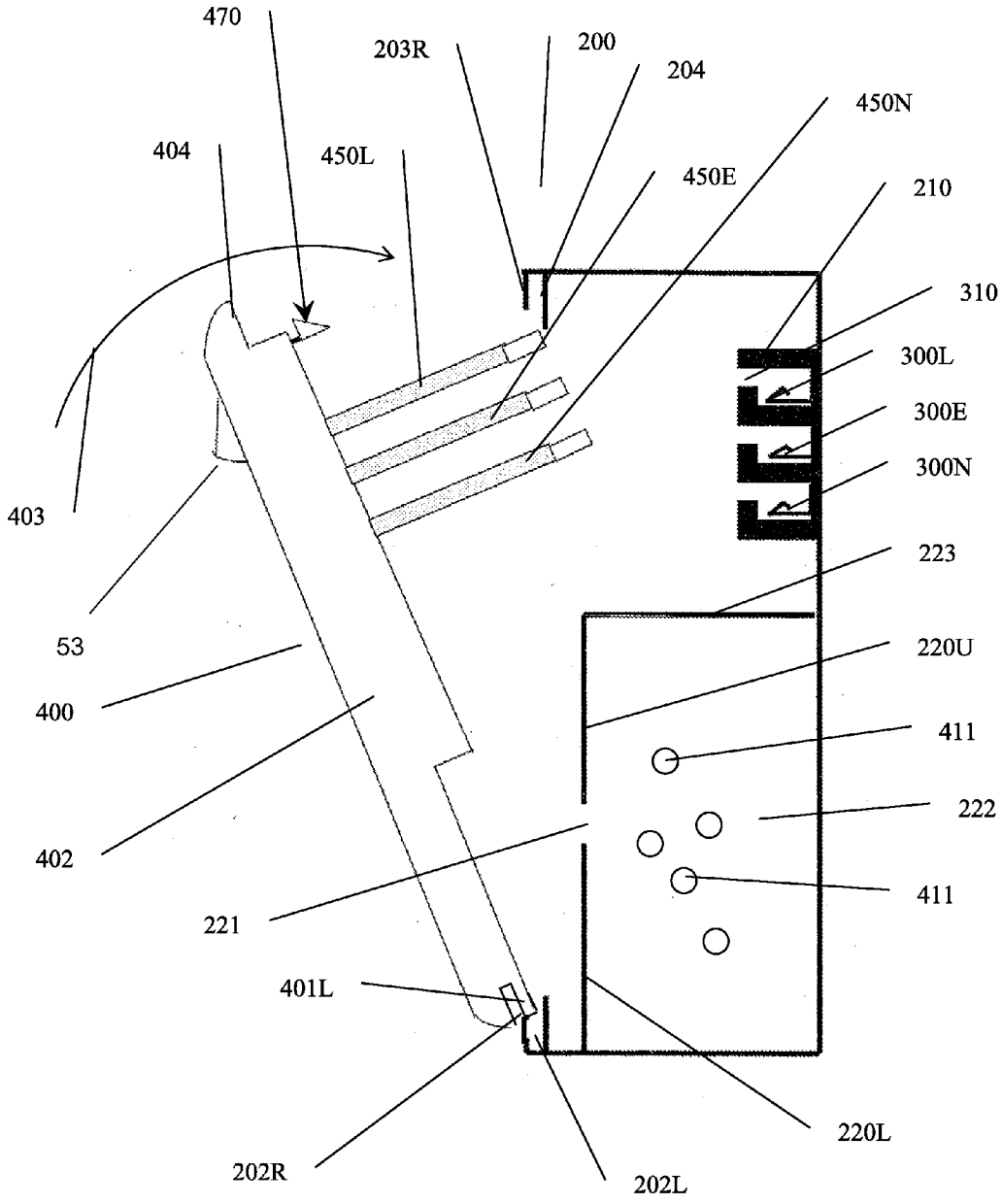
FIG. 7 shows a motion diagram of the process of attaching a power socket to the conductor casing, where the motion ultimately leads to the arrangement shown in FIG. 6.

The pivot-support has a first-support-portion and a second-support-portion. During installation, the power socket 400 is initially supported by the first-support-portion. Subsequently, immediately prior to the instant of actual entrance of the pin-to-conductor-conduction-means into the elongate-electrical-conductor-means, the support of the power socket 400 transitions from the first-support-portion to the second-support-portion. This concept of the first and second-support-portions is explained in further detail as follows:

In the embodiment, the rim 202R of the lower slot 202L acts as a first-support-portion that initially pivotally supports the power socket 400, as seen in FIG. 7.

FIG. 7 shows a motion diagram of the process of attaching the variably-locatable power socket 400 to the conductor casing 200.

As per FIG. 7, the attachment process initially requires the lower distal end of the socket-body-frame 402 to be positioned on the rim 202R of the lower slot 202L. In this tilted orientation, the lower tab 401L is skewed, i.e. tilted relative to the vertical slot 202L, and hence the lower tab 401L cannot slide into the lower slot 202L.

Subsequently, the socket-body-frame 402 is progressively pivoted towards the conductor casing 200. In FIG. 7, the direction of this progressive pivotal motion is indicated by an arrow 403.

Finally, as the socket-body-frame 402 approaches a vertical orientation, the lower tab 401L eventually also approaches a vertical orientation until it becomes sufficiently close to a vertical orientation to allow the lower tab 401L to slide into the lower slot 202L, which, in the embodiment, is the second-support-portion. Thus, immediately prior to the instant of actual entrance of the pins 450 into the slits 310, the support of the power socket 400 transitions from the rim 202R to the lower slot 202L itself. This is the two-stage process mentioned above.

In FIG. 7, the upper part of the conductor casing 200 also has an upper rim 203R, which is a mirror image of the lower rim 202R.

In FIG. 7, the upper part of the socket-body-frame 402 has a ledge 404 that is intended, when installed, to abut the outer surface of the upper rim 203R.

During installation, as the lower tab 401L slides into the lower slot 202L, as described above, the ledge 404 moves towards the outer surface of the upper rim 203R. At the moment when the lower tab 401L slides into the lower slot 202L, generally concurrently, the ledge 404 abuts the upper rim 202R. A resilient or spring loaded clip 470 locks the ledge 404 to the upper rim 202R by engaging with the rear of an inner tab 204.

Figure 11:
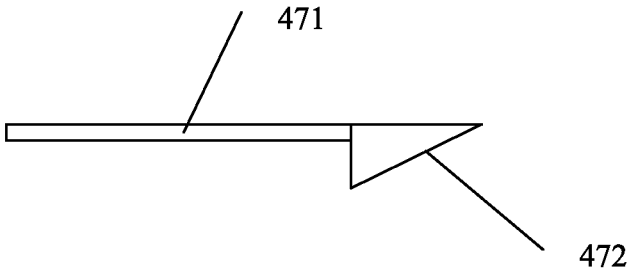
FIG. 11 shows a tool used for activating a mechanism for removing the power socket.
Figure 12:
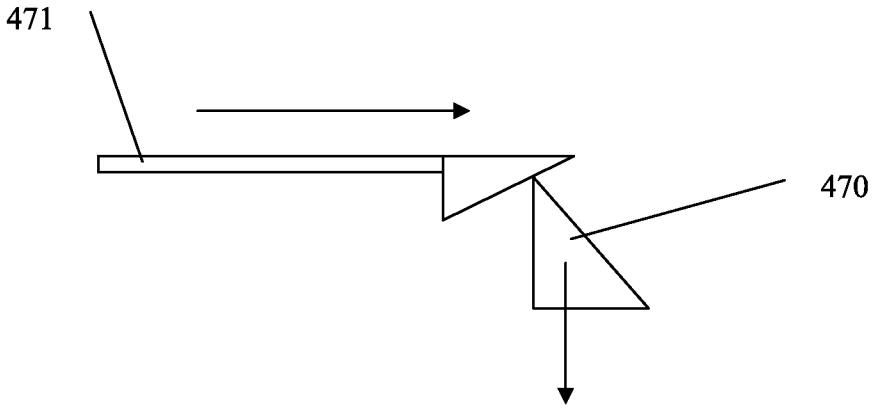
FIG. 12 shows the tool of FIG. 11 interacting with an internal component of the power socket.

In the embodiment, in order to remove the power socket 400A from the conductor casing 200, there is preferably provided a pin hole that the user can insert a tool to force the clip 470 downwards to disengage from the inner tab 204. FIG. 11 shows an example of a tool that is used to force the clip downwards, as shown in FIG. 12. The pin-like tool 471 has a sloping, leading-face 472 which, in use, acts similarly to a cam that pushes the clip 470 downwards as the tool 471 moves forwards. In other embodiments, variations of the mechanism for disengaging the locking mechanism of the power socket are possible. For instance, rather than needing to use a separate tool, a variation of the embodiment can have the face of the power socket being provided with a switch that triggers an internal, in-built cam mechanism that acts on the clip 470.

Therefore, an advantage of the embodiment is that the socket-body-frame 402 can be installed without tools, and moreover can be removed simply by using a single, simple tool 417, as compared to configurations in the prior art that require a workman to go through a significantly more complex disassembly process requiring more tools to remove and shift the location of the power socket. Significantly, in the embodiment, the socket-body-frame 402 can be inserted, installed, removed to a different location on the rail, and re-installed, all without the need to turn off the electrical power supply to the main rail 210.

In FIG. 6, once the clip 470 is forced downwards, the clip no longer holds the power socket 400A in place, and the user is able to remove the power socket 400A in an outwards pivoting motion.

As a result of the forwards pivoting motion during insertion of the power socket, illustrated in FIG. 7, the long connector pins 450 L, 450E, 450N are also brought towards their ultimate destination, which is that each of the three long connector pins 450 L, 450E, 450N should enter the respective narrow slits 310E, 310N, 310L of the main rail 210.

In the embodiment, the entrance of each of the narrow slits 310E, 310N, 310L are slightly rounded so that any imprecision in the installation sequence can be allowed a degree of leeway in terms of the alignment of the respective components that engage with each other.

The ends of each of the contacts 300E, 300N, 300L are in the form of resilient, triangular-shaped springs which, in the embodiment, each have an upwards bias so as to press up against the long connector pins 450 when each pin 450 enters its respective slit 310. The resilience and upward bias of the contacts 300 provides a press fit for the pins 450 in the slits 310.

As described above, as the socket-body-frame 402 of the power socket 400 pivots and sweeps towards the conductor casing 200 in an arc, for the majority of this arc motion the frame 402 pivots about the first-support-portion, which is in the form of the rim 202R of the lower slots 202L. In other words, for much of the sweep of its pivotal motion, the long connector pins 450 move in a false trajectory that would see the pins 450 hit the face 211 of main rail 210 out of alignment with the narrow slits 310E, 310N, 310L—if not for the fact that, at the last moment, the lower tab 401L slides into the lower slot 202L. At that last moment, the three long connector pins 450 are translated, out of the false trajectory, into a correct trajectory that enables the pins to smoothly enter the narrow slits 310E, 310N, 310L without any or substantial hindrance from the face 211 of the main rail 210.

Therefore, in the embodiment, in order to avoid the long connector pins 450 from being jammed into the face 211 of the main rail 210 while still in its false trajectory, before the last moment translation into the true trajectory, it is preferable that the protruding length of the long connector pins 450 is designed to be of such a length that each pin 450 only makes contact and enters its corresponding slit 310 at the abovementioned last moment. Some experimentation will be required, since the appropriate protrusion length of the pins 450 will depend on other size dimensions of the other components, such as the conductor casing 200, the main rail 210, and the size of the power socket 400.

Thus, the lower slot 202L itself (rather than its rim) act as the second-support-portion. The lower slot 202L supports the socket-body-frame 402 of the power socket 400 such that, immediately prior to the instant of actual entrance of the pins 450 into the slits, the pins 450 enter the slits at least substantially straight-ahead in a true trajectory to avoid damage to the pins.

The long connector pins 450 are perpendicular to the plane of frame 402 of the power socket 400, hence, the precaution—of ensuring that the pin 450 only enters the slit 310 at the abovementioned last moment—will also ensure that the pins enter the slits in an orientation that is as perpendicular as possible, relative to the face 211 of the main rail 210, i.e. the straight-ahead alignment.

Data Connection Points

In the embodiment of FIG. 2, one or more data connection points 410 can be selectively attached to the conductor casing 200. Data connection points 410 can be attached at any location along the length of the conductor casing 200.

In the embodiment, the one or more data connection points are associated and linked to data-cables or data-wiring 411.

In the embodiment, the data connection point is supported on a data-point-body-frame (not shown) that is similar to the socket-body-frame 402 of FIG. 7, except that the data-point-body-frame omits long connector pins 450 L, 450E, 450N and associated wiring.

The similarity of the overall frame of the data-point-body-frame is intended to allow the data-point-body-frame to be selectively attached to the conductor casing 200 with a similar pivoting motion, as has been described for the socket-body-frame 402.

In the embodiment, the interior of the conductor casing 200 includes data-cable-confinement-means that confines any data cables to part of the interior of the conductor casing 200. This confinement of the data cables preferably are sufficient to avoid interference between the data cables 411 and the electrical circuit components of the socket 400, namely the long connector pins 450 L, 450E, 450N and the contacts 300E, 300N, 300L of the main rail 210.

In the embodiment of FIG. 2, the data-cable-confinement-means is in a form that includes a plurality of resilient fingers 220U, 220L.

A cut-away portion in FIG. 2 shows a front view of the of resilient fingers 220 which have an appearance of a lower row of upwardly projecting fingers 220L, and an upper row of downwardly depending fingers 220U. FIGS. 4 to 7 show side views of the fingers.

In FIGS. 4 to 7, the downwardly depending fingers 220U have an overall L-shaped body with a stem 223 that is attached to and extends from the rear inner surface of the case 200.

In FIG. 6, between the upper 220U and lower 220L rows of fingers, there is a gap 221 through which the workman is able to push data cables 411 into a region 222 inside the conductor casing 200 where the cables 441 are confined.

The data cables are thus confined to part 222 of the interior, i.e. not the whole, of the conductor casing 200 using the data-cable-confinement-means.

Such confinement of the data cables 411 to a restricted part 222 of the conductor casing 200, rather than allowing the data cables to take up any location inside the conductor casing 200, ensures that the data cables 411 will not interfere with the entry or withdrawal of the long connector pins 450 L, 450E, 450N inside the conductor casing 200.

In the embodiment, the fingers 220 are particularly useful for confining the data cables, especially when the fascia panel 405 is temporarily removed. Without the fingers, the often large number of data cables might fall out of the casing 200 if the fascia 405 were to be removed without the benefit of the fingers 220 to confine the data cables.

In FIGS. 4 to 7, there are five data connection wires 411 shown, however, in practice, the number of data wires 411 depends on the number of data connection points 410 that are attached along the length of the conductor casing 200. Each data connection point 410 has its own individual cable 411 leading to the connection point 410.

In other modifications, the data-cable-confinement-means can be in alternative forms. For instance, rather than having fingers, an alternative embodiment can replace the upper and lower fingers 220U, 220L instead with flexible panels that achieve the same function as the fingers.

In the embodiment of FIG. 6, there is a gap between the upper and lower fingers 220U, 220L, whereas in alternative embodiments, the edges of the upper and lower parts can be provided with a releasable locking mechanism. In such an embodiment, once the cables 411 have been inserted, the upper and lower parts can be locked together. For example, the locking mechanism can be in the form of clips or some other suitable configuration.

Other Modifications

In other modifications, the straight-ahead-alignment-means is not limited to a pivotal motion. For example, as an alternative, the upper and lower slots 202U, 202L may be provided with straight-ahead-alignment-means in the form of alignment cut-out portions which could guarantee appropriate alignment of the pins and slits, if the power socket 400 were to be guided into connection with the casing 200 in a movement that is precisely guided by the cut-out slots.

Extension

Figure 9:
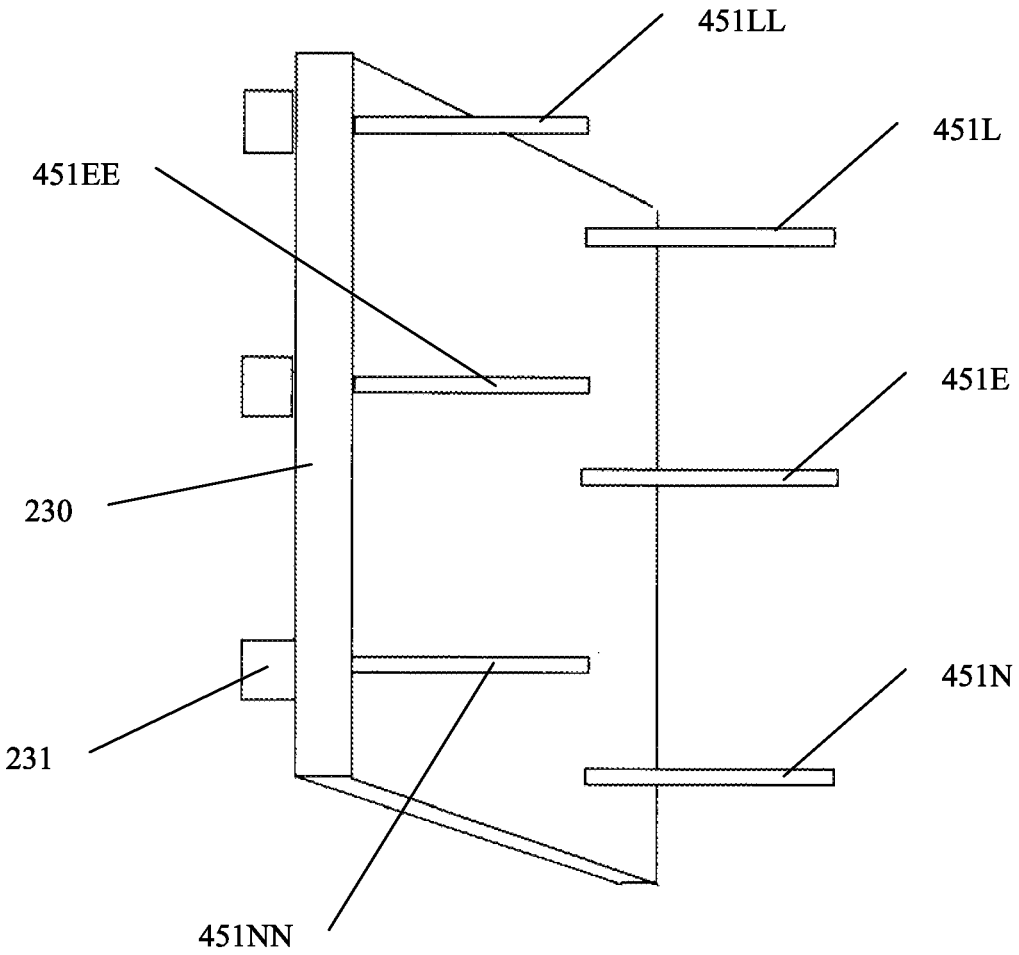
FIG. 9 shows a perspective view of a circuit-connector that can be used to connect the main rail to another main rail, in order to form a longer combined rail.

In order to create longer lengths of rail 210, two or more of the main rails 210 can be joined together with a circuit-connector 230 shown in the perspective view of FIG. 9.

The circuit-connector 230 is used to connect the main rail of FIGS. 9 to 13 to another main rail 230 to form a longer rail of combined length of the two joined rails.

In FIG. 9, the circuit-connector 230 is provided with two parallel sets of circuit-connector pins 451L, 451E, 451N, and 451LL, 451EE, 451NN. One set 451L, 451E, 451N can be inserted into the slits 310A of a first main rail 210, while the other set 451LL, 451EE, 451NN can be inserted into a second main rail, so that the first and second main rails are thus joined to form a longer rail.

In FIG. 9, there is wiring or circuitry (not shown) to provide electrical connection between the two sets of circuit-connector pins on either side of the circuit-connector 230.

Figure 10:
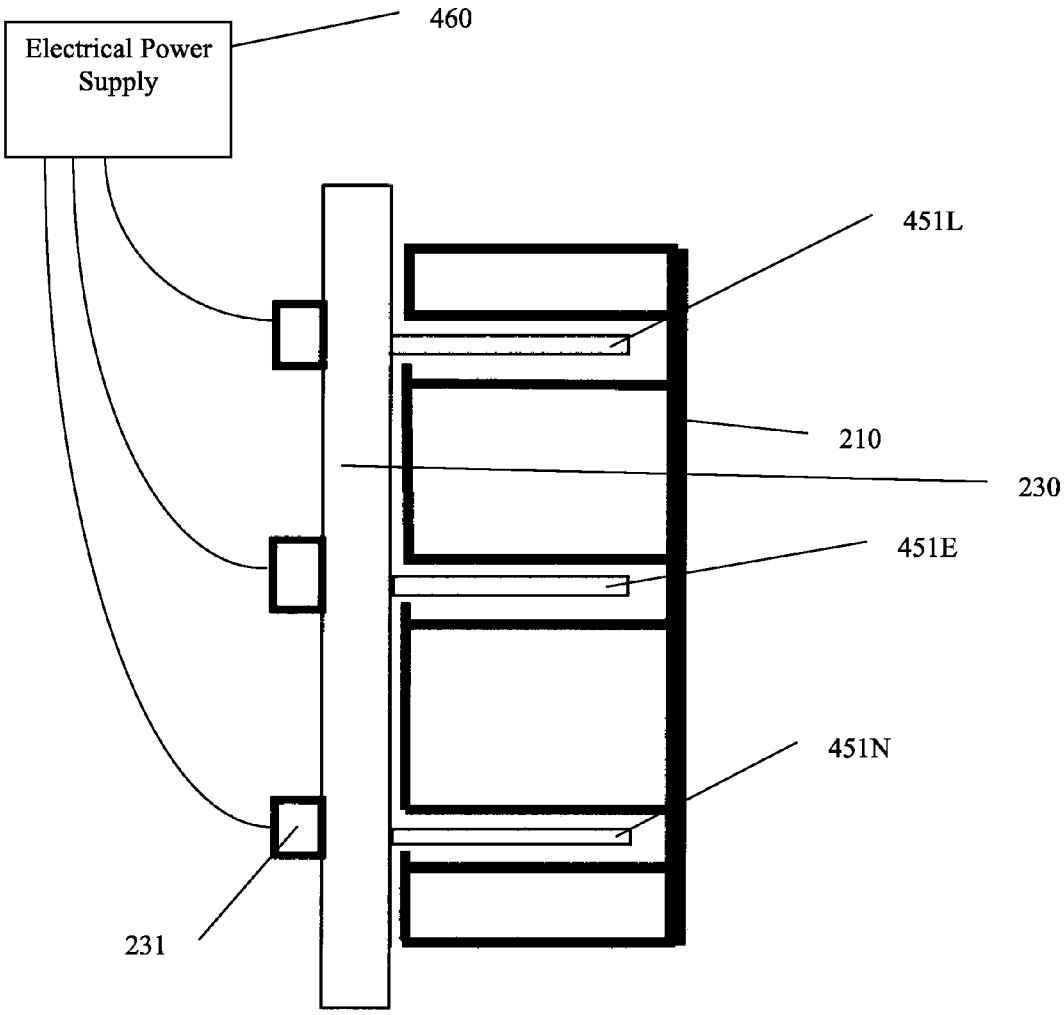
FIG. 10 shows a schematic, cross-sectional side view of the circuit-connector of FIG. 11, shown with the connector inserted into a main rail (internal details of the main rail have been omitted from FIG. 10 for simplicity)

FIG. 10 shows a schematic, cross-sectional side view of one set of circuit-connector pins 451L, 451E, 451N inserted into the slits of one of the main rails to be joined to another. In other words, the circuit-connector pins 451L, 451E, 451N is able to physically connect two adjacent main rails together so that electrical current can run from one main rail through to its adjacent main rail via the circuit-connector that connects the two rails 210 together.

Another use of the circuit-connector 230 is that it can connect the main rail 210 to the electrical power supply. For example, in this mode, one set of circuit-connector pins 451L, 451E, 451N is inserted into the main rail 210, while the second set of pins 451L, 451E, 451N on the same connector 230 is inserted into a connector (not shown) that ultimately leads to the power supply 460. In other words, the circuit-connector 230 can act as a modular mechanism for attaching the main rail 210 to the source of electrical power supply.

The circuit-connector 230, in FIG. 10, is connected to an electrical power source. The circuit-connector 230 is provided with screw terminals 231 which are in electrical contact with the pins 451L, 451E, 451N. The terminals 231 facilitate connection to the electrical power supply.

When the pins 451L, 451E, 451N of the circuit-connector 230 are inserted into the main rail 210, this connects the contacts, 300E, 300N, 300L to the electrical power source 460.

Figure 13:
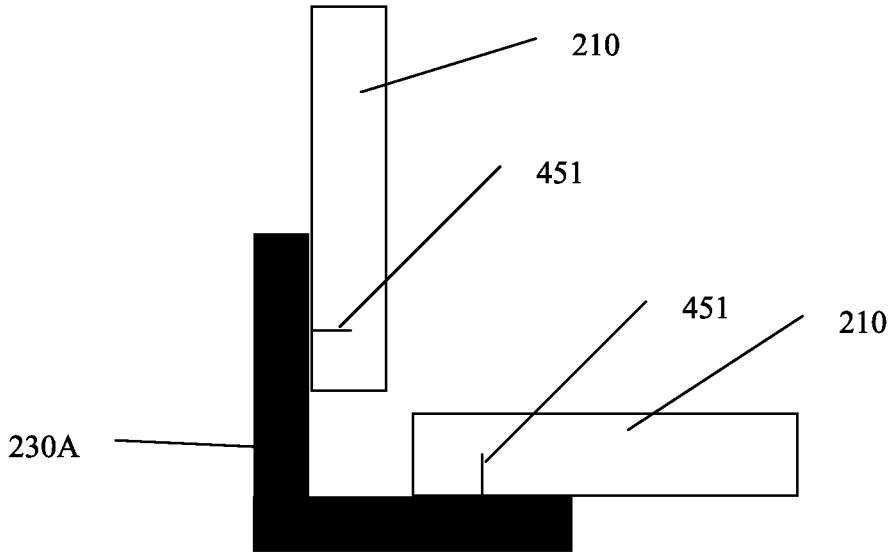
FIGS. 13 and 14 show different embodiments of circuit-connectors that can be used to join main rails in a transverse arrangement at corners.
Figure 14:
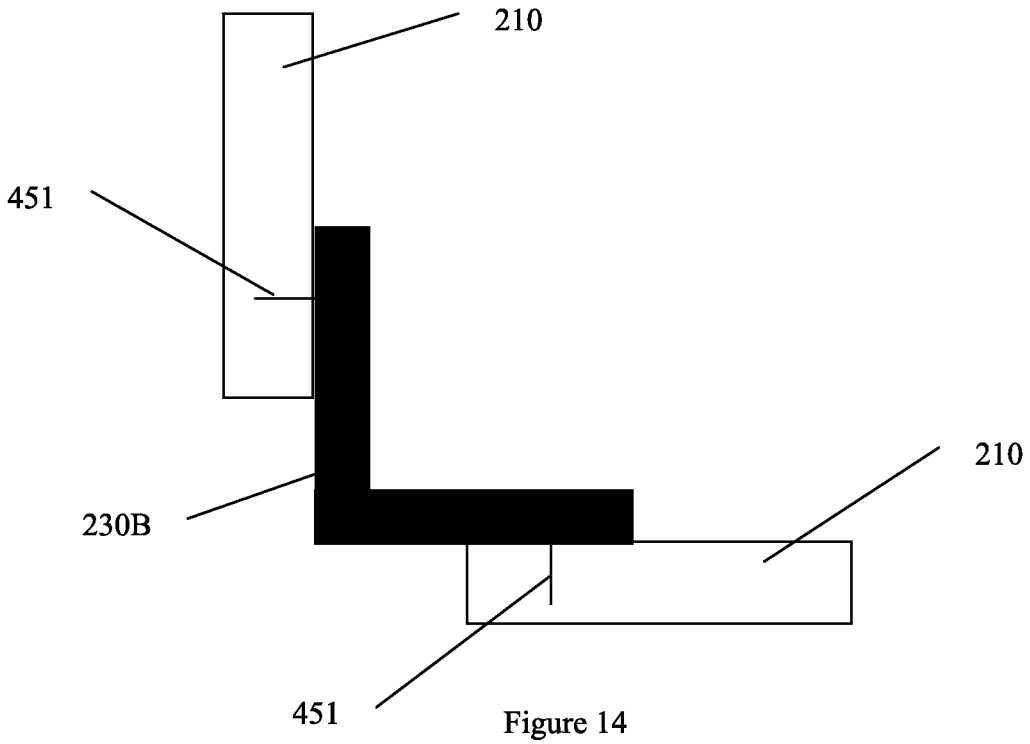

FIGS. 13 and 14 show variations of circuit-connector 230A, 230B which can be used at corners of walls. In these variations, the circuit-connector 230A, 230B has two arms that are transverse to one another, each arm being provided with circuit-connector pins 451.

In the specification, the notion of the sockets and data connection points being provided along a wall can include these being provided along a horizontal stretch of the wall, or even along a vertical stretch of the wall. The sockets and data connection points can be provided along the base of the wall, or along a stretch of the wall raised above the ground, for example, provided at the level of a desktop surface.

The embodiments have been advanced by way of example only, and modifications are possible within the scope of the invention as defined by the appended claims.

In this specification, where the words comprise or comprises or derivatives thereof are used in relation to elements, integers, steps or features, this is to indicate that those elements, steps or features are present but it is not to be taken to preclude the possibility of other elements, integers, steps or features being present.

The invention claimed is:

1. A method of providing one or more variably-locatable electrical sockets along a wall to enable pins of an electrical plug to be inserted at selectively variable locations along the wall to obtain electrical power therefrom, the method comprising:

providing elongate-electrical-conductor-means along at least part of a wall;

providing elongate-conductor-enclosure-means along the wall so as to substantially enclose the elongate-electrical-conductor-means therein in its interior;

connecting the elongate-electrical-conductor-means to a power source, such that, in use, the elongate-conductor-enclosure-means prevents inadvertent contact between a user and the electrically-live elongate-electrical-conductor-means therein;

providing a power-socket-means that has pin-to-conductor-conduction-means able to electrically link the elongate-electrical-conductor-means to pins of an electrical plug inserted into the power-socket-means; and selectively attaching said power-socket-means at substantially any location along the elongate-conductor-enclosure-means such that, when the pins of an electrical plug are inserted into the power-socket-means, an electrical connection is made between the pins and said power source through the pin-to-conductor-conduction-means and via the elongate-electrical-conductor-means, wherein during attachment of the power-socket means to the elongate-conductor-enclosure means, the method includes:

using straight-ahead-alignment-means to cause a leading portion of the pin-to-conductor-conduction-means, at instant of actual entrance, to enter at least substantially straight into the elongate-electrical-conductor-means rather than entering misaligned or entering at an angle that causes damage of the pin-to-conductor-conduction-means, and wherein the straight-ahead-alignment-means includes:

a pivot-support which has a first-support-portion and a second-support-portion such that, during the attachment, the method includes:

pivotally supporting the power-socket-means using the first-support-portion such that the pin-to-conductor-conduction-means moves towards the elongate-conductor-enclosure-means in a false trajectory, and prior to the instant of actual entrance of the pin-to-conductor-conduction-means into the elongate-electrical-conductor-means, supporting the power-socket-means using the second-support-portion such that the pin-to-conductor-conduction-means enters the elongate-electrical-conductor-means at least substantially straight ahead in a true trajectory to avoid damage to the pin-to-conductor-conduction-means.

2. A method of claim 1 wherein the method also includes selectively attaching one or more data connection points at substantially any location along the elongate-conductor-enclosure-means;

and wherein the method includes using data-cable-confinement-means within the elongate-conductor-enclosure-means to confine any data cables, associated with the one or more data connection points, to part of the interior of the elongate-conductor-enclosure-means so as to avoid interference between the data cables and the pin-to-conductor-conduction-means and the elongate-electrical-conductor-means within the elongate-conductor-enclosure-means.

3. A method of claim 2 wherein, immediately prior to the instant of actual entrance of the pin-to-conductor-conduction-means into the elongate-electrical-conductor-means, the method includes transitioning the support of the power-socket-means from the first-support-portion to the second-support-portion.

4. A method of claim 3 wherein the elongate-conductor-enclosure-means is provided with facia-panel-means that is removable to reveal and provide access to the interior of the elongate-conductor-enclosure-means, and wherein the method includes adjusting the length of the facia-panel-means by breaking the facia-panel-means along scored lines of weakness provided thereon.

5. A power-socket-means adapted to be used in the method of claim 4.

6. A power-socket-means adapted to be used in the method of claim 4 wherein the power-socket-means is substantially as hereinbefore described and illustrated with reference to the accompanying drawings.

7. Elongate-conductor-enclosure-means adapted to be used in the method of claim 4 wherein the elongate-conductor-enclosure-means is substantially as hereinbefore described and illustrated with reference to the accompanying drawings.

8. The method of claim 3 wherein the straight-ahead-alignment-means is substantially as hereinbefore described and illustrated with reference to the drawings in FIGS. 4 to 7 of the accompanying drawings.

9. A power-socket variable location system adapted to provide one or more variably-locatable electrical sockets along a wall to enable pins of an electrical plug to be inserted at selectively variable locations along the wall to obtain electrical power therefrom, the system comprising:

elongate-electrical-conductor-means adapted to be located, in use, along at least part of a wall and adapted to be connected to a power source;

elongate-conductor-enclosure-means adapted to substantially enclose the elongate-electrical-conductor-means therein in its interior such that, in use, the elongate-conductor-enclosure-means prevents inadvertent contact between a user and the electrically-live elongate-electrical-conductor-means therein;

one or more power-socket-means that each have pin-to-conductor-conduction-means able to electrically link the elongate-electrical-conductor-means to pins of an electrical plug inserted into the power-socket-means;

straight-ahead-alignment-means adapted, during attachment of the power-socket-means to the elongate-conductor-enclosure-means, to enable a leading portion of the pin-to-conductor-conduction-means, at instant of actual entrance, to enter at least substantially straight into the elongate-electrical-conductor-means rather than entering misaligned or entering at an angle that causes damage of the pin-to-conductor-conduction-means, wherein the straight-ahead-alignment-means includes a pivot-support which has a first-support-portion and a second-support-portion such that, during the attachment:

the first-support-portion, in use, is able to pivotally support the power-socket-means such that the pin-to-conductor-conduction-means moves towards the elongate-conductor-enclosure-means in a false trajectory, and the second-support-portion, in use, is able to support the power-socket-means such that, immediately prior to the instant of actual entrance of the pin-to-conductor-conduction -means into the elongate-electrical-conductor-means, the pin-to-conductor-conduction-means enters the elongate-electrical-conductor-means at least substantially straight ahead in a true trajectory to avoid damage to the pin-to-conductor-conduction-means;

wherein said one or more power-socket-means are able to be selectively attached at substantially any location along the elongate-conductor-enclosure-means such that when the pins of an electrical plug are inserted into the power-socket-means, an electrical connection is able to be made between the pins and said power source through the pin-to-conductor-conduction-means and via the elongate-electrical-conductor-means.

10. The system of claim 9 wherein one or more data connection points are able to be selectively attached at substantially any location along the elongate-conductor-enclosure-means;

and wherein the elongate-conductor-enclosure-means includes therein data-cable-confinement-means adapted to confine any data cables, associated with the one or more data connection points, to part of the interior of the elongate-conductor-enclosure-means sufficient to avoid interference between the data cables and the pin-to-conductor-conduction-means and the elongate-electrical-conductor-means within the elongate-conductor-enclosure-means.

11. A power-socket-means adapted to be used in the system of claim 10.

12. A power-socket-means adapted to be used in the system of claim 10 wherein the power-socket-means is substantially as hereinbefore described and illustrated with reference to the accompanying drawings.

13. Elongate-conductor-enclosure-means adapted to be used in the system of claim 10 wherein the elongate-conductor-enclosure-means is substantially as hereinbefore described and illustrated with reference to the accompanying drawings.

14. The system of claim 9 wherein, in use, support of the power-socket-means transitions from the first-support-portion to the second-support-portion immediately prior to the instant of actual entrance of the pin-to-conductor-conduction-means into the elongate-electrical-conductor-means.

15. The system of claim 14 wherein the elongate-conductor-enclosure-means is made of a non-conductive material.

16. The system of claim 15 wherein the elongate-conductor-enclosure-means is provided with facia-panel-means that is removable to reveal and provide access to the interior of the elongate-conductor-enclosure-means, and wherein the facia-panel means is adapted to be adjustable in terms of its length by breaking the facia-panel means along scored lines of weakness provided thereon.

17. A power-socket-means adapted to be used in the system of claim 16.

18. A power-socket-means adapted to be used in the system of claim 16 wherein the power-socket-means is substantially as hereinbefore described and illustrated with reference to the accompanying drawings.

19. Elongate-conductor-enclosure-means adapted to be used in the system of claim 16 wherein the elongate-conductor-enclosure-means is substantially as hereinbefore described and illustrated with reference to the accompanying drawings.

20. A power-socket-means adapted to be used in the system of claim 15.

21. A power-socket-means adapted to be used in the system of claim 15 wherein the power-socket-means is substantially as hereinbefore described and illustrated with reference to the accompanying drawings.

22. Elongate-conductor-enclosure-means adapted to be used in the system of claim 15 wherein the elongate-conductor-enclosure-means is substantially as hereinbefore described and illustrated with reference to the accompanying drawings.

23. The system of claim 14 wherein the straight-ahead-alignment-means is substantially as hereinbefore described and illustrated with reference to the drawings in FIGS. 4 to 7 of the accompanying drawings.

* * * * *